US010080074B2

(12) United States Patent
Pavlovic

(10) Patent No.: US 10,080,074 B2
(45) Date of Patent: Sep. 18, 2018

(54) DRIP CONTROL DEVICE FOR A BOOM MICROPHONE

(71) Applicant: AKG Acoustics GmbH, Vienna (AT)

(72) Inventor: Gino Pavlovic, Vienna (AT)

(73) Assignee: AKG Acoustics GmbH, Vienna (AT)

( * ) Notice: Subject to any disclaimer, the term of this patent is extended or adjusted under 35 U.S.C. 154(b) by 0 days.

(21) Appl. No.: 15/223,648

(22) Filed: Jul. 29, 2016

(65) Prior Publication Data

US 2017/0034609 A1 Feb. 2, 2017

(30) Foreign Application Priority Data

Jul. 31, 2015 (EP) ..... 15179295

(51) Int. Cl.
*H04R 25/00* (2006.01)
*H04R 1/08* (2006.01)
*H04R 1/12* (2006.01)

(52) U.S. Cl.
CPC ..... *H04R 1/083* (2013.01); *H04R 1/12* (2013.01); *H04R 1/086* (2013.01); *H04R 2201/107* (2013.01)

(58) Field of Classification Search
CPC . H04R 1/02; H04R 1/08; H04R 1/083; H04R 1/086; H04R 1/12; H04R 25/654; A47G 21/00
USPC ..... 381/362
See application file for complete search history.

(56) References Cited

U.S. PATENT DOCUMENTS

2008/0044002 A1* 2/2008 Bevirt ..... H04M 1/05 379/430
2015/0373444 A1* 12/2015 Chiang ..... H04R 1/04 381/355
2015/0373447 A1* 12/2015 Ball ..... H04R 1/086 381/359

FOREIGN PATENT DOCUMENTS

DE 202005005668 U1 6/2005
DE 202014005350 U1 8/2014

OTHER PUBLICATIONS

AKG, "User Instructions Microphone C544", http://cloud.akg.com/8264c.5441_manual.pdf, Mar. 31, 2011, 64 pages.
European Search Report for corresponding Application No. 15179295.9, dated Nov. 19, 2015, 10 pages.

* cited by examiner

*Primary Examiner* — Phylesha Dabney
(74) *Attorney, Agent, or Firm* — Brooks Kushman P.C.

(57) ABSTRACT

The present invention relates to a drip control device for a boom microphone for installation around the boom at a distance from the microphone. To improve the dripping off beads of perspiration, the drip control device as measured in the direction of the boom, has a length (L) and as measured in the direction perpendicular to the boom, a length (D) and that with respect to ratio of these dimensions, such a ratio L/D is greater than 1.

12 Claims, 3 Drawing Sheets

DRIP CONTROL DEVICE FOR A BOOM MICROPHONE

CROSS-REFERENCE TO RELATED APPLICATIONS

This application claims priority to EP Application Serial No. 15179295.9 filed Jul. 31, 2015, the disclosure of which is hereby incorporated in its entirety by reference herein.

TECHNICAL FIELD

The subject matter of the present invention relates to a drip control device for a boom microphone and a boom microphone fitted therewith.

BACKGROUND

The term "boom microphone" refers to two types of microphones. The first type, which is not the subject matter of this invention, is positioned on a large "gallows" arm which, during filming, is held by a second person in such a manner that the microphone always remains outside the frame. The second type to which this invention refers comprises extremely miniaturized microphones that are attached to the end of a long, thin, wire-like structure, where the wire-like structure, the boom, is either part of a so-called headset (headworn microphone) or mounted on the head of the user in such a manner that the microphone on the end of the boom is positioned as closely as possible near the mouth of the user. For practical reasons, positioning the microphone in front of the mouth of the user is not feasible although it would be desirable for acoustic reasons. Applications include theater productions, operetta and musical productions, panel discussions and many other events. The data recorded by the microphone is, as a rule, transmitted via a radio transmitter which is conveniently attached to the body of the user and connected to the microphone, in most cases by means of a cable.

One of the main technical problems associated with the use of this type of boom microphones is the perspiration of the user, especially since microphones in most cases are used during athletic activities or under intense spotlights, and since frequently considerable physical effort on the part of the user is involved. Thus, it can happen that individual beads of perspiration run along the boom and, on its end, reach the microphone, the opening of which, though located on the side facing away from the boom, is usually smaller than the bead of perspiration so that, because of capillary effects, it is highly possible for the beads of perspiration to enter into the microphone, which in this case generally leads to the destruction of the microphone.

As a prophylactic measure, the state of the art provides for the use of small disks which are usually pushed from the back surface of the boom microphone along the boom up to a short distance from the microphone and which are intended to serve as drip control devices since they prevent the beads of perspiration from continuing along their path, and once a sufficiently large bead has accumulated, cause the beads of perspiration to drip off. The material used for these drip control disks is generally silicone.

In spite of this general use, the success of these drip control disks leaves much to be desired, and perspiration continues to flow into the microphone and often enough causes the microphone to be destroyed.

Thus, the problem to be solved by the present invention is to remedy this situation and to provide a drip control device which works considerably more reliably than the devices known from the prior art.

SUMMARY

According to the present invention, this problem is solved by the features mentioned in the present claims. In other words, by using a drip control device which, in the direction of the boom, is considerably larger than in the direction perpendicular to the boom (the radial direction) may solve the problem. This drip control device preferably consists of a silicone thread that is wound around the boom or of an elongated hollow cylinder with a specially structured outer jacket surface.

As a result of this drip control device which is reminiscent of a helical spring or a cylinder with surface protrusions, a drop of considerable size is formed so that, during the movement of the user, the inertial forces which promote dripping are by far greater than the surface forces which promote a continued flow of the drop along the boom, thus reliably preventing the drop from continuing its flow. In addition, because of the elasticity of the silicone thread, mounting and dismounting is considerably simplified and the replacement, which is desirable for hygienic reasons but which is often neglected because the replacement is cumbersome, can now be done easily and therefore frequently.

BRIEF DESCRIPTION OF THE DRAWINGS

The invention will be explained in greater detail based on the drawing. As can be seen.

DETAILED DESCRIPTION

Figure 1:
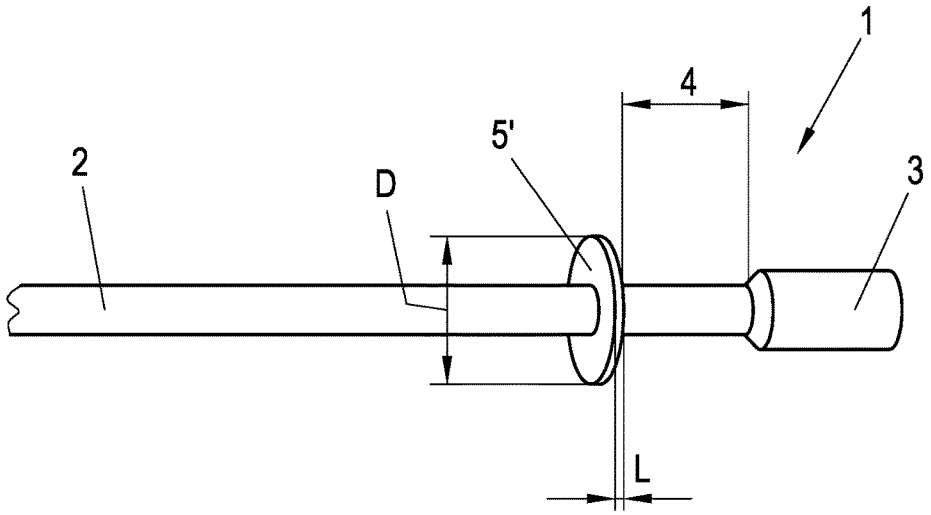
FIG. 1 shows a schematic view of a prior-art boom microphone.

As can be seen, FIG. 1 shows the front portion of the boom microphone which overall is designated by 1. On the end of the boom 2, a miniaturized microphone 3 is positioned, and in the area adjacent to, but at a certain distance 4 from, the microphone 3, a center of a circular silicone disk 5' is disposed on the boom 2. Beads of perspiration flowing along the boom 2 are stopped by this disk 5' and are intended to drip off said disk instead of continuing on their path to the microphone 3. Although this occurs frequently, it does not occur always and therefore poses a risk to broadcasts and/or performances, not to mention the risk to the microphone. The thickness of the disk 5', i.e., its extension L (mm) in the direction of an axis of the boom 2 is considerably shorter than its diameter D (mm); L/D is considerably lower than 1.

Figure 2:
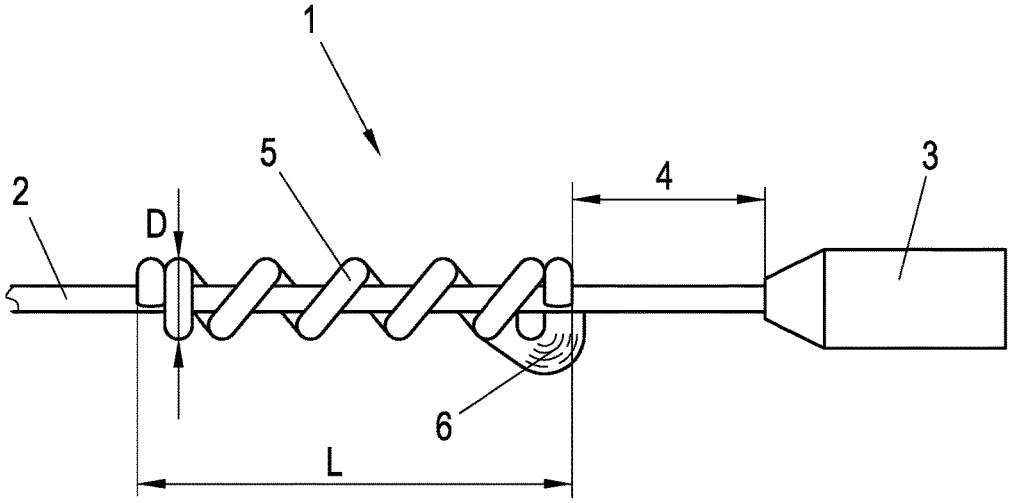
FIG. 2 shows a schematic view of a first embodiment of a boom microphone according to the present invention.
Figure 3:
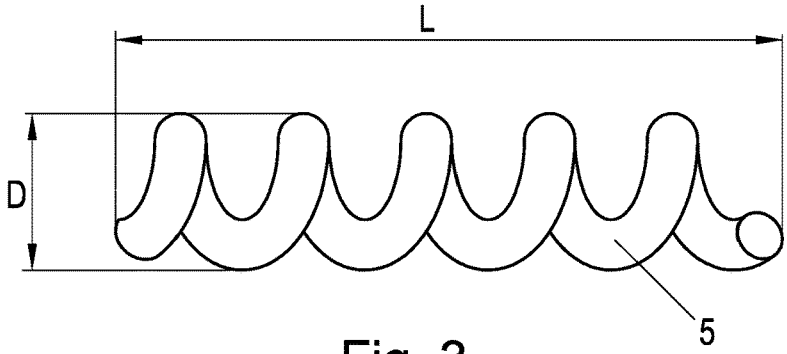
FIG. 3 shows a second embodiment.
Figure 4:
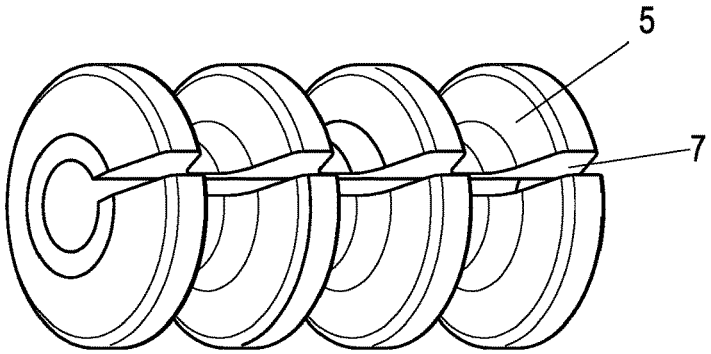
FIGS. 4 to 8 show more embodiments.
Figure 5:
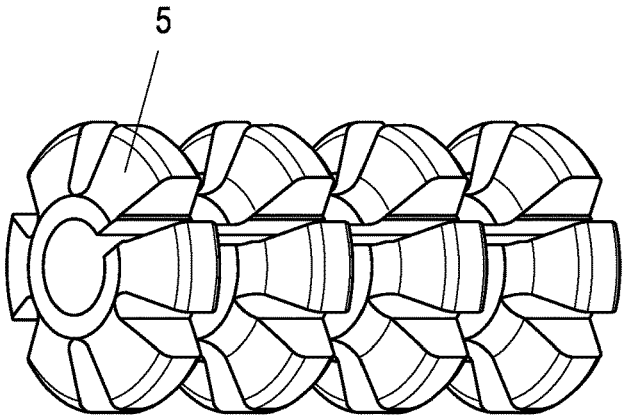
Figure 6:
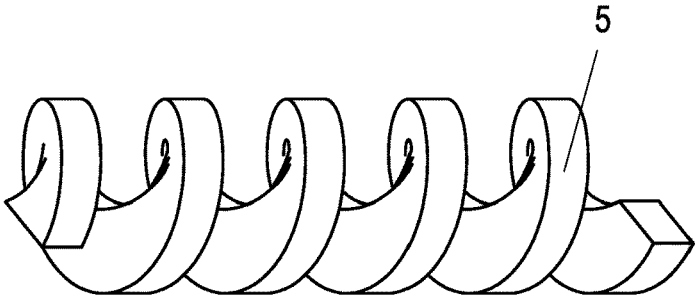
Figure 7:
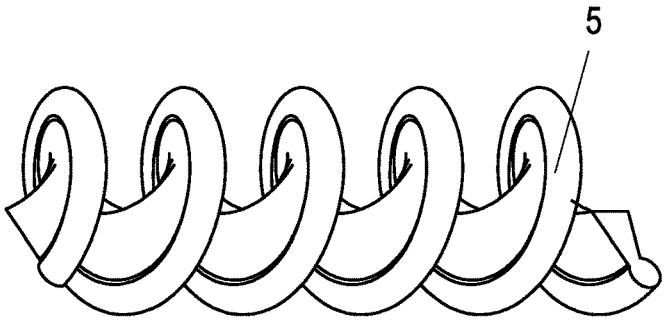
Figure 8:
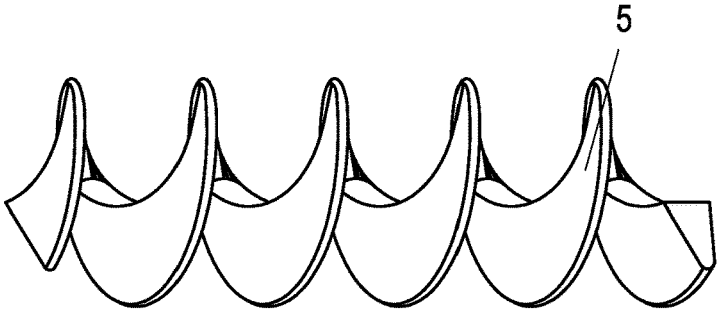

FIG. 2 shows a drip control device according to the present invention, i.e., a silicone screw 5 which is provided in place of the disk 5'. As can be readily seen, the extension of this screw perpendicular to the boom 2, again expressed by the diameter D (mm), in comparison to its longitudinal extension along the boom 2 with a length L (mm), is considerably lower, in other words, L/D is considerably greater than 1.

In the lower end region of the silicon screw 5, which is adjacent to the microphone 3, a bead of perspiration 6 is indicated, which bead, on the silicone screw 5, has grown to a considerable size due to the helical and/or loose screw-like structure of said screw and which, because of its high mass, much more readily tends to drip off instead of continuing to run along the boom into region 4 of the boom. It should be noted that the proportions of the microphone 3 relative to the bead of perspiration 6 accurately reflect the proportions actually encountered with boom microphones 1 which are the subject matter of the present invention.

With respect to the conventional prior-art drip control disks, the extension in the radial direction (best described by the diameter relative to the fictitious axis of the boom 2) is comparable to the dimensions of the diameter D of the drip control device according to the present invention; however, because of the character of the small disk, the extension in length is reduced to nearly zero and significantly shorter than D. This has the effect that only very small droplets are formed which tend "to climb over" the disk and subsequently continue to run along the boom 2 until they reach the microphone. The physical cause of this phenomenon is that the surface forces are greater than the inertial forces.

The use of a silicone thread or band that is "wound" around the boom 2 is a very simple and inexpensive variation; it is, of course, also possible to use structures which by nature have, broadly speaking, (essentially) the shape of a hollow cylinder and a radial cut 7 across the entire length and thickness (FIG. 4) and which, through elastic deformation, are pushed in an approximately radial direction onto the boom 2. Such a cut can also have a screw-like design so as to reliably prevent the formation of a longitudinal gap. The outer jacket surface of such a hollow cylinder can have the most varied kind of grooves, nubs, ribs, ridges, wells, dents, indentations and other structural elements of a general type so as to make sure that the device can receive and hold the growing size of the beads of perspiration. A few potential embodiments are shown in FIGS. 3 to 8.

The material to be used can be silicone identical to that of the prior-art drip control disks. It is also possible to use a hydrophilic, or at least a non-hydrophobic material, as the surface material of such a drip control structure, especially in combination with a hydrophobic boom surface, in particular, in the region 4 between the drip control device 5 and the microphone 3, so as to ensure the formation of large, and therefore readily dropping, drops. An absorptive material does not offer any better results since, given the normal accumulation of perspiration, the absorptive capacity is rapidly exhausted and subsequently does nothing to contribute to the performance.

LIST OF NUMERALS

01 Boom microphone
02 Boom
03 Microphone
04 Distance
05 Drip-help
05' Disk
06 Drop
07 Radial cut
L Length in boom-direction
D Length in radial-direction

What is claimed is:

1. A drip control device for a boom microphone for installation around a boom at a distance from the boom microphone, wherein the drip control device extends longitudinally along a length (L) of the boom and has a length (D) that extends perpendicular to the boom and wherein a ratio of the length (L) and the length (D) is greater than one, wherein the drip control device has a shape of a hollow cylinder;

wherein the hollow cylinder includes a plurality of ring-like structures formed on an outer surface thereof;

wherein a cut is formed in each ring-like structure and in the hollow cylinder and the cut extends across an entire length and an entire thickness of the of the hollow cylinder; and wherein the plurality of ring-like structures provide inertial forces to promote a drip off of water from the drip control device during movement of the drip control device.

2. The drip control device of claim 1, wherein the cut extends across an entire length of each ring-like structure.

3. The drip control device of claim 1 wherein a gap is formed between each ring-like structure to separate each ring-like structure from one another.

4. The drip control device of claim 1 being made of silicone or a thermoplastic material.

5. A drip control device for a boom microphone for installation around a boom being spaced apart from the boom microphone, wherein the drip control device has a length (L) and a length (D), and wherein a ratio of the length (L) and the length (D) is greater than one;

wherein the drip control device has a shape of a hollow cylinder;

wherein the hollow cylinder includes a plurality of ring-like structures formed on an outer surface thereof;

wherein a cut is formed in each ring-like structure and in the hollow cylinder and the cut extends across an entire length and an entire thickness of the of the hollow cylinder; and wherein the plurality of ring-like structures provide inertial forces to promote a drip off of water from the drip control device during movement of the drip control device.

6. The drip control device of claim 5, wherein the cut extends cross an entire length of each ring-like structure.

7. The drip control device of claim 5, wherein a gap is formed between each ring-like structure to separate each ring-like structure from one another.

8. The drip control device of claim 5 being made of silicone or a thermoplastic material.

9. A drip control device for a boom microphone that is positioned around a boom, the drip control device being spaced apart from the boom microphone, wherein the drip control device has a length (L) and a length (D), and wherein a ratio of the length (L) and the length (D) is greater than one, wherein the drip control device has a shape of a hollow cylinder;

wherein the hollow cylinder includes a plurality of ring-like structures formed on an outer surface thereof;

wherein a cut is formed in each ring-like structure and in the hollow cylinder and the cut extends across an entire length and an entire thickness of the hollow cylinder; and wherein the plurality of ring-like structures provide inertial forces to promote a drip off of water from the drip control device during movement of drip control device.

10. The drip control device of claim 9, wherein the cut extends across an entire length of each ring-like structure.

11. The drip control device of claim 9, wherein a gap is formed between each ring-like structure to separate each ring-like structure from one another.

12. The drip control device of claim 9 being made of silicone or a thermoplastic material.

* * * * *